US005857268A

United States Patent [19]

Park

[11] Patent Number: 5,857,268

[45] Date of Patent: Jan. 12, 1999

[54] POCKET TOOL

[76] Inventor: Kyunghan Park, (19/8) 76-2 Yokchon-dong, Unpyong-gu, Seoul, Rep. of Korea

[21] Appl. No.: 743,034

[22] Filed: Nov. 4, 1996

[30] Foreign Application Priority Data

Nov. 4, 1995 [KR] Rep. of Korea ..... 1995-32347

[51] Int. Cl.[6] ..... B25B 23/18

[52] U.S. Cl. ..... 30/146; 362/119; 7/118

[58] Field of Search ..... 30/123, 125, 143, 30/145, 146, 131; 362/119, 120; 7/158, 118, 160

[56] References Cited

U.S. PATENT DOCUMENTS

| | | | |
|---|---|---|---|
| 4,783,867 | 11/1988 | Tsao | 7/160 |
| 4,854,045 | 8/1989 | Schaub | 30/155 |
| 5,442,529 | 8/1995 | Hoover | 362/119 |
| 5,467,256 | 11/1995 | Chen | 362/119 |
| 5,653,525 | 8/1997 | Park | 362/119 |

*Primary Examiner*—Hwei-Siu Payer
*Attorney, Agent, or Firm*—Whitham, Curtis & Whitham

[57] ABSTRACT

An exact movement of the scissors is provided by using elastic power of an elastic panel fixed on the fixed scissors body, wherein the front edge is installed in the coupling groove of the moving scissors body. A lighter or the flashlight may be mounted on the pocket tool. By installing the rear part of the elasticity panel such that the front edge has a part cut properly on the same line and to cooperate with the fixed scissors body and by installing the front edge of the part in the coupling groove made in the lower edge of the moving scissors body, it is possible to move the scissors exactly and repetitively because only the front edge part of the elasticity panel conveys the elastic power and is confined by the moving scissors body. The rear part of the elasticity panel is fixed on the fixed scissors body, and the flashlight or lighter etc. is coupled to the hollow surface formed by the coupling projection of the body.

5 Claims, 5 Drawing Sheets

POCKET TOOL

BACKGROUND OF THE INVENTION

1. Description of the Invention

The present invention relates, to a pocket tool where small blades or a can opener and scissors may be enclosed, and, more particularly, to improvements for the precise repetitive movement of the scissors and for mounting a flashlight and a lighter on the pocket tool.

2. Description of the Prior Art

The scissors of a known pocket tool, as shown in FIG. 7, have a structure moved with the plate-shaped spring 100 by fixing only one side of the plate-shaped spring 100 on the fixed scissors body, by cutting properly that front edge of spring 100 to be placed at the same axle with the fixed scissors body 101, and by coupling the moving body 102 with a special coupling pin 107 so that it can be folded up with the fixed body 101.

If the plate-shaped spring 100 is not installed in an exact position because the plate-shaped spring 100 is not located exactly onto the same axle, or the spring becomes twisted in use, as may occur when the moving scissors body 102 is not precisely installed on the plate-shaped spring 100, it is impossible to move the moving scissors body 102 repetitively and exactly. When when this plate-shaped spring is enclosed in the tool body, because this plate-shaped spring is then in a compressed state by the moving scissors body 102, if the compressed state is maintained for a long time, the plate-shaped spring 100 may lose its elasticity. If the front edge of this plate-shaped spring 100 can move, it may spoil the appearance of the tool. Because the moving body 102 can not hold spring 100 in order to move in the fixed range, the moving body 102 can not closely and exactly position the plate-shaped spring 100 consistent with motion of the moving body 102. Then, it is impossible to move the moving body 102 exactly and repetitively.

Recently, to solve these problems, fold-up panels 201 have been used. Fold-up panels 201 have a structure such that the projection 206 of the moving body 205 is moved repetitively by being held closely to the contour 207 of the fold-up panel 201 as shown in FIG. 10 when coupled with the tool body 204 to meet together with the fixed scissors body 203 by the coupling pin 202 as shown in FIG. 8.

But, as this fold-up panel 201 is for the repetitive movement in being moved as shown in FIG. 9A, 9B by using the elasticity power of the plate spring 208 which is provided for the purpose of pulling out the scissors from the body 204, or folding the scissors into body 204 when the fold-up panel 201 is installed in the body 204 in the folded up state pressed as shown in FIG. 9B, elasticity of plate spring 208 may be damaged. As it moves, the sloped surfaces 200, 207 of the fold-up panel 201 and the projection of the moving scissors body 205 are held closely together as shown in FIG. 10. If the formation of the slope 207 is not precise, panel 201 and projection 206 may become disengaged or bind and thus useless. Alternatively, since the fold-up panel 201 is supported by being held on one side of this fixed scissors body 203, and being held closely to the projection 206 of the moving scissors body 205, and the angle of the handles of the moving scissors body 205 may be substantial, then there may be difficulty in manufacture to cut inward the handle part of the moving scissors body 205 when the angle of handles is reduced. When the moving body 205 widens outward, there may be the problem that the fold-up panel 201 and the projection 206 of the moving scissors body 205 which cooperate together are separated because the movement of moving scissors body 205 is not limited.

SUMMARY OF THE INVENTION

According to this invention, it is possible to move the scissors exactly and repetitively by fixing the rear part of the elasticity panel having a front part which is cut to a proper angle, installing the elasticity panel on the same axle with the fixed scissors body, and installing the front edge of the elasticity panel on the coupling groove made in the moving scissors body. Since the cut part of the rear edge part of the elasticity panel is fixed in the fixing scissors body, the panel is fixed in the fixing scissors body, the elasticity panel exhibits the elasticity power while the cut part of the front edge of the elasticity panel is confined. In combination with the tool (scissors etc.), one can mount a lighter or flashlight on the pocket tool by coupling the flashlight or lighter etc. to the tools with a coupling projection formed to engage a hollow part of the axle 7.

BRIEF DESCRIPTION OF THE DRAWINGS

The above and other objects, features and other advantages of the present invention will be more clearly understood from the following detailed description taken in conjunction with the accompanying drawings, in which:

FIG. 17 is a perspective view of the state that the lighter is mounted on.

DESCRIPTION OF THE PREFERRED EMBODIMENTS

Figure 1:
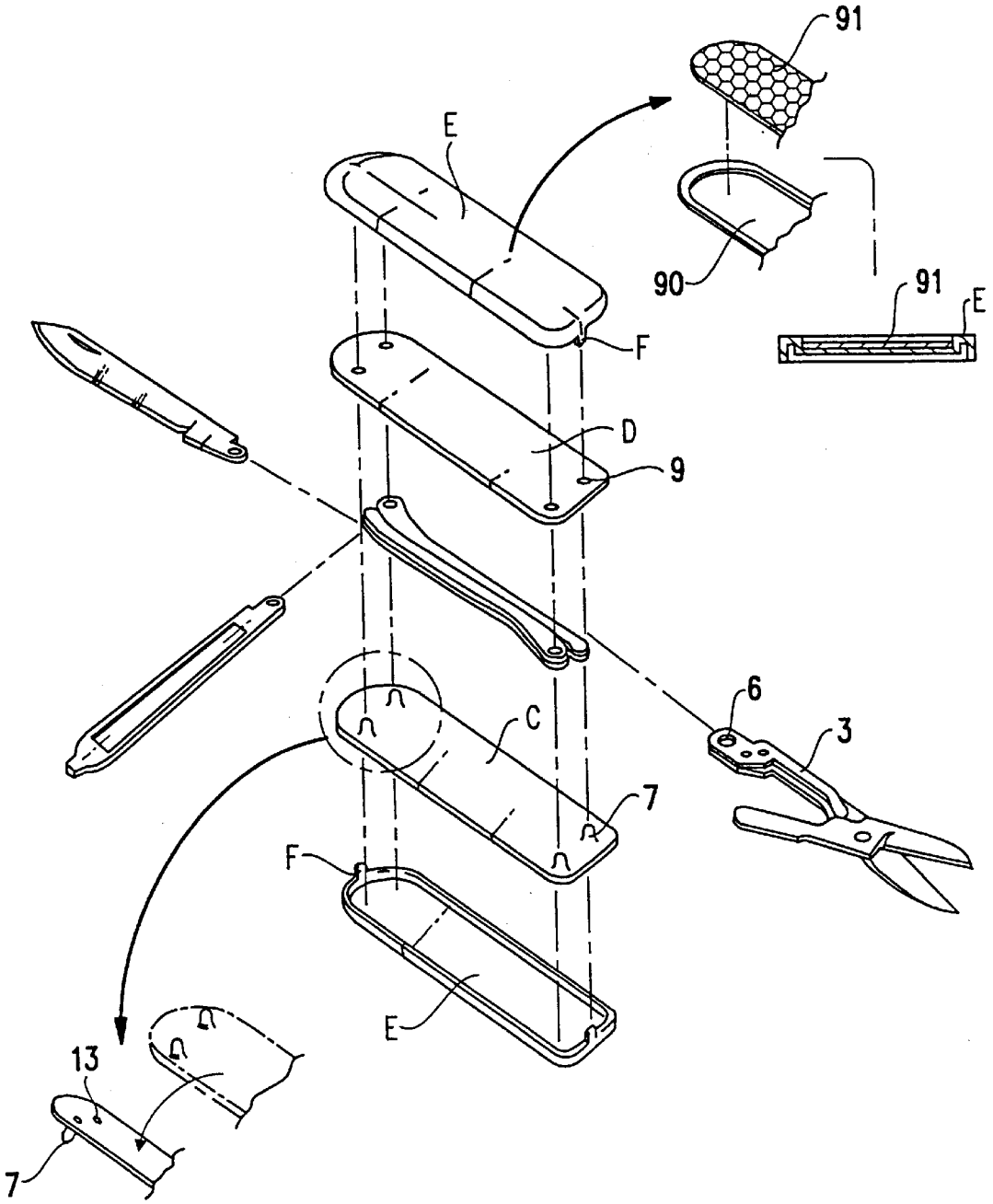
FIG. 1 is an exploded perspective view that the products of this invention is coupled with the body.
Figure 2:
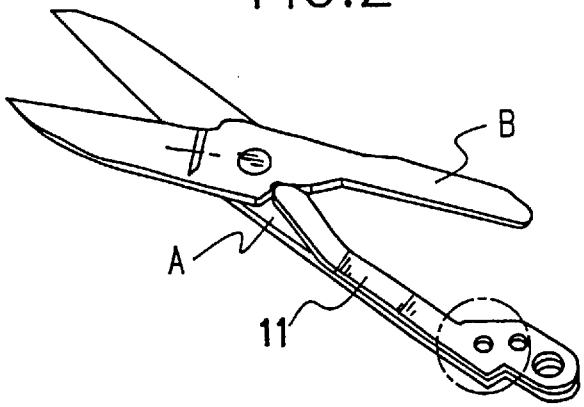
FIG. 2 is an enlarged perspective view of the scissors part.
Figure 3:
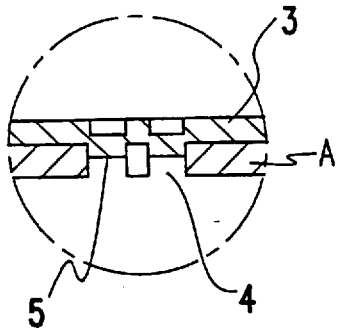
FIG. 3 is a cross section representing the fixing state of the elasticity panel and the fixing scissors body.
Figure 4:
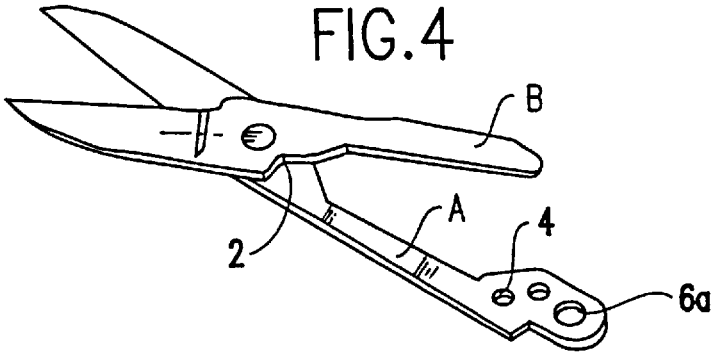
FIG. 4 is a perspective view of the scissors.
Figure 5:
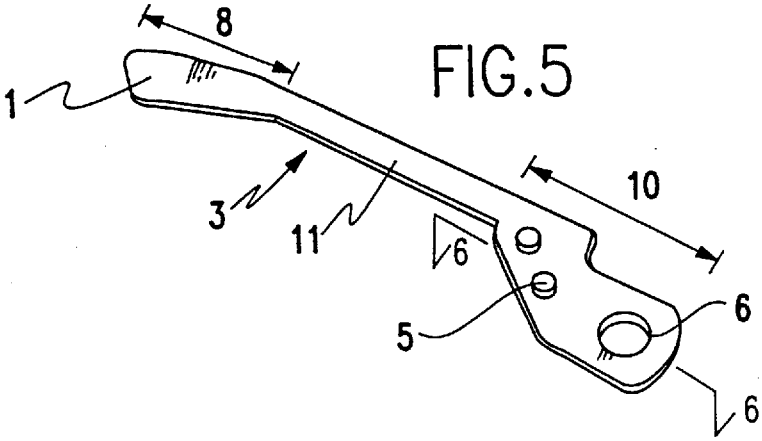
FIG. 5 is a perspective view of elasticity panel.
Figure 6:
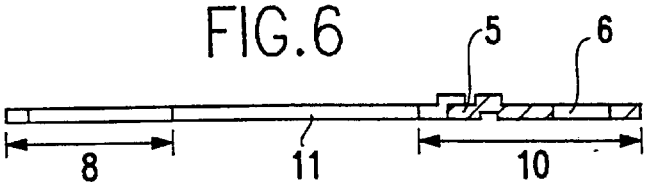
FIG. 6 is a cross section of A—A line of FIG. 5.
Figure 7:
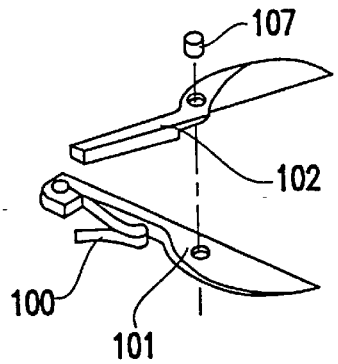
FIG.7 PRIOR ART
FIG. 7 is a perspective view representing the composition of the usual scissors.
Figure 8:
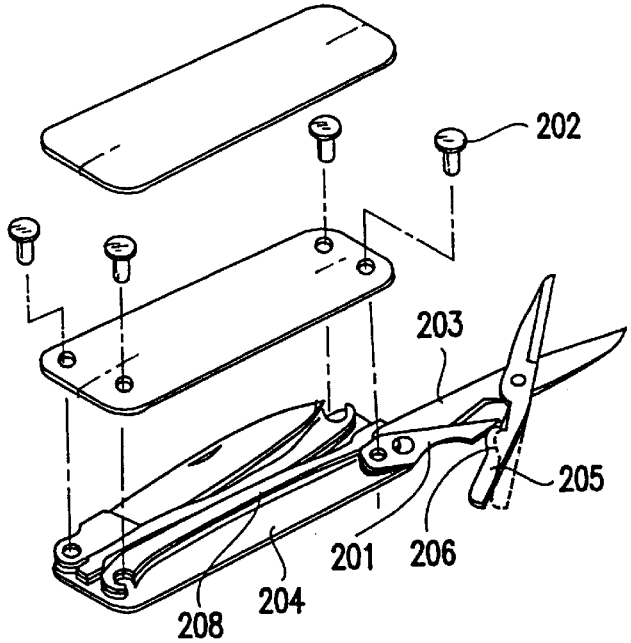
FIG.8 PRIOR ART
FIG. 8 is an exploded perspective view of a known improvement over the scissors of FIG. 7 which are combined to the body.
Figure 9A:
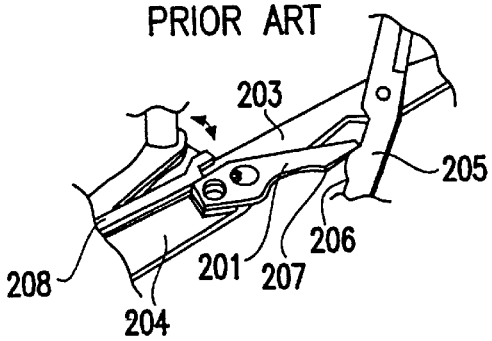
FIG.9A PRIOR ART
FIG. 9A is a perspective view of the scissors of FIG. 8 representing the previous state that the scissors are not compressed.
Figure 9B:
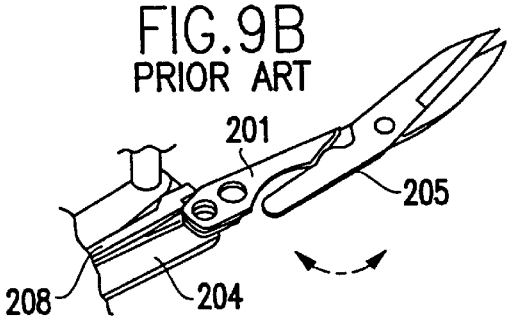
FIG.9B PRIOR ART
FIG. 9B is a perspective view of the scissors of FIG. 8 that the scissors are compressed.
Figure 10:
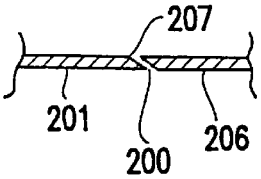
FIG.10 PRIOR ART
FIG. 10 is a cross section representing the close adhesion of slope of the fold-up panel and the projection of the scissors of FIG. 8.
Figure 11:
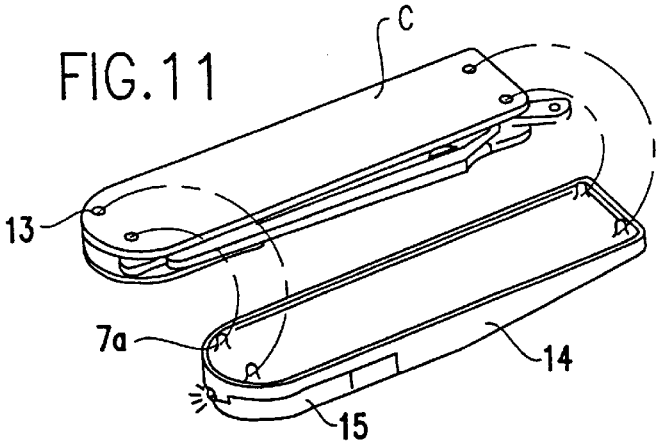
FIG. 11 is a perspective view of the state that the flashlight is mounted on the hollow groove of the other plate of the body.
Figure 12:
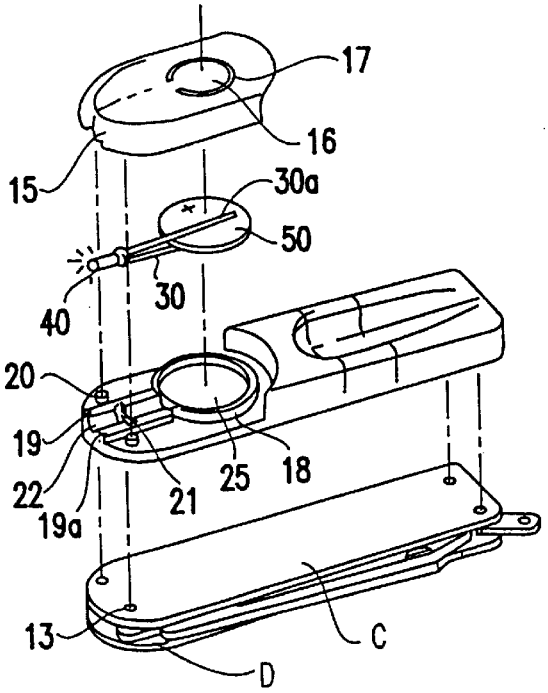
FIG. 12 is an exploded perspective view representing the structure of the flashlight.

In the invention, as shown in FIG. 1 to FIG. 6, the front region 8 of elasticity panel 3 has a part 1 cut in a proper angle so that it may not be separated from the coupling groove 2 of the moving scissors body (B). In the rear part 10, two fixing projections 5 are pressed on one side so that it may be held by being inserted into the fixing hole 4 of the fixed scissors body (A). In the rear part 10 of the elasticity panel 3, a coupling hole 6 is formed for installation on the same axle with the fixed scissors body (A) the formed by coupling projection 7 made in one side plate (C) of the tool body. The coupling hole 6 of the above elasticity panel 3 is thus formed to be coupled with the coupling projection 7 of the body (C) forming a common axle for the coupling hole 6*a* of the fixed scissors body (A).

Thus, if the moving scissors body (B), when two fixing projections 5 of the rear part 10 of the elasticity panel 3 are inserted and fixed into the two fixing holes 4 of the fixed scissors body (A), and the front edge of the part 1 is installed by being engaged with the coupling groove 2 of the moving body (B), the front edge 8 of the elasticity panel 3 moves the moving scissors body (B) repetitively by the elastic power of the control body 11 of elasticity panel 3.

The fixing projection 5 of the elasticity panel 3 doesn't separate from the moving scissors body (B) because the fixing projection 5 is inserted into the fixing hole of the rear part of the elasticity panel 3 and is covered with the other side panel (D) so that the fixing projection 5 may not be separated from fixing hole 4.

Furthermore, the part 1 of the front edge 8 and the part that the fixing projection 5 of the rear part 10 are formed thickly more than the central portion 11 of the elasticity panel 3 which has excellent elastic power since central control body 11 is preferably thin and of uniform thickness.

Figure 18:
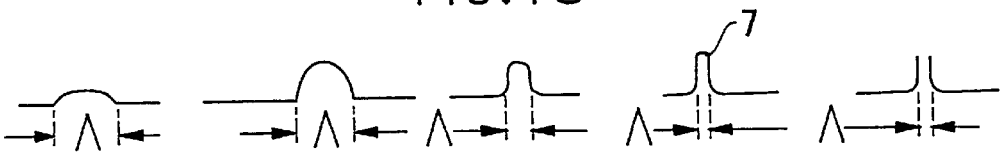
FIG. 18 is a process order drawing illustrating progressive formation of a coupling projection (in cross-section).

The method fixing these tools (scissors body etc.) on the coupling projection 7 of the tool body (C) does not require a special coupling pin by virtue of placing the various tools (scissors etc.) onto the coupling projection 7. The coupling projection 7 is formed as a hollow cylinder 13 by successive pressing (refer to the process drawing of FIG. 18) and cutting and widening the part projected upward through hole 9 in the other side panel (D) which is drilled to engage the coupling projection 7.

The cover (E) covers the bodies (C,D) and is attached thereto by projection (F). The cover can be of various designs such as by forming the hollow part 90 on an outer surface and attaching the leather 91 as shown in FIG. 1. Further, in this hollow part 90 one can provide products of various design by manufacturing it with special Logo forms. The formation of this hollow part 90 is preferably done with press molding.

Also, as shown in FIG. 11 to FIG. 15, one can supply the pocket tool with a flashlight mounted on it by a coupling projection 7*a* (FIG. 11) which is inserted into the hollow cylinder 13 of coupling projection 7 of one side panel (C) of the body.

The flashlight structure preferably includes a fixing groove 21 formed at a right angle to a curved hollow groove 22 between guide projections 19, 19*a* so that the bulb 40 including terminals 30, 30*a* may be installed. A coupling hollow part 26 cooperating with a ring shaped part 18 are preferably provided in the flashlight body 14 such that a receiving part 25 is formed by the ring-shaped part 18 to hold the battery 50 in the center, a resilient button 16 is formed in order to have the elastic power at incised part 17 in the inside surface of the cover 15. An elastic body 24 is also provided in cover 15 in order to accommodate one side terminal 30*a* of the bulb 40.

These parts are connected by the coupling projection 20 of the body 14 and the coupling groove 23 of the cover 15.

When assembled, the curved hollow groove 22*a*, the fixing groove 21*a* which correspond to the curved hollow groove 22 and the fixing groove 21 of the flashlight body 14 are formed so that the bulb 40 and terminals 30, 30*a* may be precisely held in position when installed.

The terminals 30, 30*a* of the bulb 40 are installed above and below the battery 50 received in the receiving part 25, and one terminal 30*a* of the upper part is held spaced therefrom.

For this, one can widen two terminals 30, 30*a*, and separate the terminal 30*a* by cutting.

Because the battery 50 is received in the receiving part 25, and one terminal 30*a* of the bulb 40 remains separated above or below the battery 50, the bulb 40 is not energized. When elasticity button 16 of the cover 15 is pressed, the terminal 30*a* is fixed and pressed exactly by the elastic body 24 attached on the lower side of the elasticity button 16, and the terminal 30*a* is pressed against the battery 50, the circuit is closed and the bulb 40 is energized.

Figure 13:
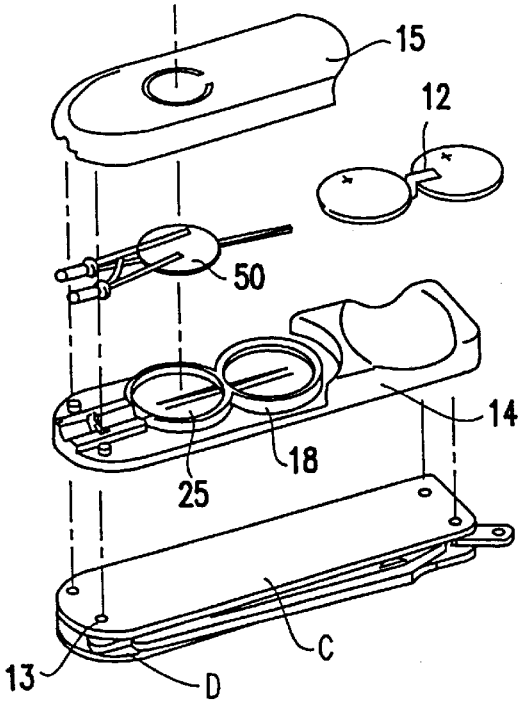
FIG. 13 is a perspective view representing the other structure of the flashlight used the cut terminal.
Figure 14:
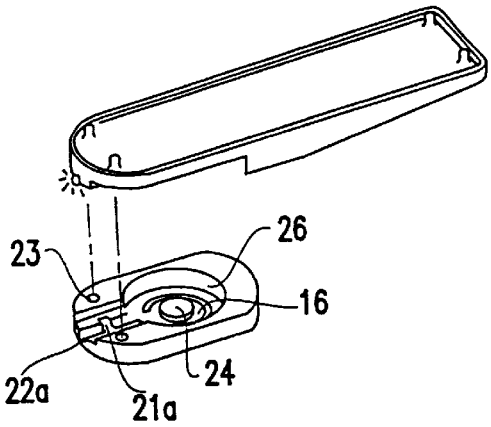
FIG. 14 is a perspective view representing combination state of the rear surface of the flashlight and the button part.
Figure 15:
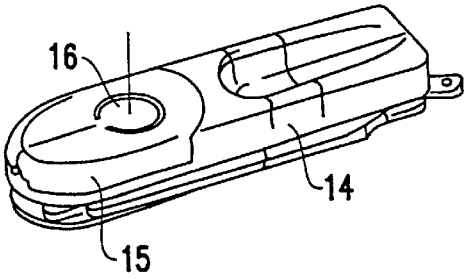
FIG. 15 is a perspective view of the state that the flashlight is mounted on the pocket tool body.

Two bulbs 40 can be provided and two batteries can be connected in series by using terminal 12 as shown in FIG. 13.

Thus, a multi-functional pocket tool is provided by mounting the flashlight on one side of the pocket tool.

Figure 16:
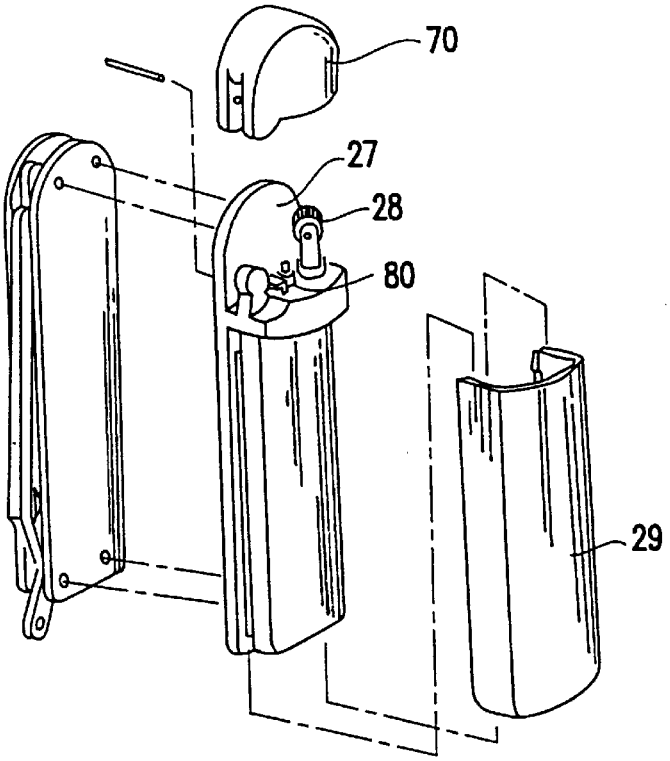
FIG. 16 is a perspective view representing the state of mounting the lighter.
Figure 17:
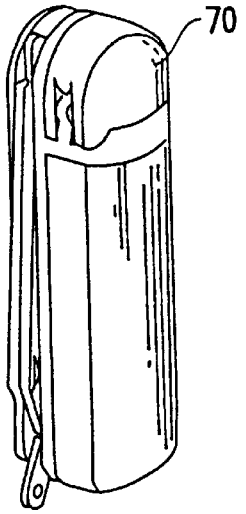

A lighter 60 can also be mounted on the tool using this combination principle. For example, as shown in FIG. 16, diaphragm 27 is formed toward the lighting nozzle of the lighter to form a coupling projection similar to 7*a*, discussed above on one side of the lighter 60 on the opposite side of diaphragm 27 from the lighter mechanism. The wheel is preferably mounted diagonally at 45° for the smooth movement of the lighter wheel 28. To control opening and closing of the gas, the principle of the lifting up and lowering the nozzle 80 when closing and opening the cover 70 is preferably used.

Further, to accommodate the various bodies of lighters, a slideably removable cap 29 is preferably provided to cover and retain the body of lighter.

What is claimed is:

1. A pocket tool comprising a tool body having a coupling projection formed thereon, a scissors structure having a fixed scissors body and a moving scissors body movable relative to said fixed scissors body, said scissors structure being mounted on said coupling projection, and an elasticity panel having a front portion shaped to be retained by a coupling groove formed on said moving scissors body and a rear portion having a means for coupling said elasticity panel to said fixed scissors body and a means for mounting said elasticity panel on said coupling projection.

2. A pocket tool as recited in claim 1, wherein said means for coupling said elasticity panel to said fixed scissors body includes a fixing projection formed on one of said fixed scissors body and said elasticity panel and a recess in the other of said fixed scissors body and said elasticity panel.

3. A pocket tool as recited in claim 1, further including at least one of a flashlight and a lighter including a further coupling projection for engaging a hollow cylinder of said coupling projection of said tool body.

4. A pocket tool as recited in claim 1, further including a flashlight including a further coupling projection for engaging a hollow cylinder of said coupling projection of said tool body, said flashlight including a curved hollow groove formed by guide projections for locating a terminal of a bulb, a fixing groove formed perpendicularly to said curved hollow groove for locating said bulb, a ring-shaped part for receiving a battery, and a resilient button for moving said terminal of said bulb against said battery.

5. A pocket tool as recited in claim 4, further including a further bulb connected in series with said bulb, a further battery, and a terminal for connecting said battery in series with said further battery.

* * * * *